US007060905B1

(12) United States Patent
McMahon

(10) Patent No.: US 7,060,905 B1
(45) Date of Patent: Jun. 13, 2006

(54) ELECTRICAL CABLE HAVING AN ORGANIZED SIGNAL PLACEMENT AND ITS PREPARATION

(75) Inventor: Roy P. McMahon, Indianapolis, IN (US)

(73) Assignee: Raytheon Company, Waltham, MA (US)

( * ) Notice: Subject to any disclaimer, the term of this patent is extended or adjusted under 35 U.S.C. 154(b) by 97 days.

(21) Appl. No.: 09/990,723

(22) Filed: Nov. 21, 2001

(51) Int. Cl.
*H01B 7/00* (2006.01)

(52) U.S. Cl. ..... 174/110 R; 174/113 R

(58) Field of Classification Search ..... 174/36, 174/102 R, 105 R, 108, 113 R
See application file for complete search history.

(56) References Cited

U.S. PATENT DOCUMENTS

| | | | | | |
|---|---|---|---|---|---|
| 2,953,627 | A | * | 9/1960 | Malneritch et al. | 174/102 R |
| 3,324,233 | A | * | 6/1967 | Bryant | 174/131 R |
| 3,678,177 | A | * | 7/1972 | Lawrenson | 174/113 C |
| 3,829,603 | A | * | 8/1974 | Hansen et al. | 174/115 |
| 4,158,104 | A | | 6/1979 | Ross | |
| 4,767,890 | A | * | 8/1988 | Magnan | 174/28 |
| 4,818,820 | A | | 4/1989 | LaRock | |
| 5,268,676 | A | * | 12/1993 | Asprey et al. | 345/169 |
| 5,373,103 | A | | 12/1994 | Orr, Jr. et al. | |
| 5,408,560 | A | * | 4/1995 | Seynhaeve et al. | 385/101 |
| 5,491,299 | A | * | 2/1996 | Naylor et al. | 174/36 |
| 5,504,540 | A | * | 4/1996 | Shatas | 348/844 |
| 5,573,857 | A | | 11/1996 | Auger | |
| 5,659,152 | A | * | 8/1997 | Horie et al. | 174/113 R |
| 5,695,152 | A | * | 12/1997 | Levy | 244/3.13 |
| 5,763,836 | A | * | 6/1998 | Anastasi et al. | 174/92 |
| 5,777,273 | A | * | 7/1998 | Woody et al. | 174/113 R |
| 5,808,239 | A | * | 9/1998 | Olsson | 174/113 C |
| 5,834,699 | A | * | 11/1998 | Buck et al. | 174/113 R |
| 5,864,094 | A | * | 1/1999 | Griffin | 174/105 R |
| 5,976,070 | A | * | 11/1999 | Ono et al. | 600/110 |
| 6,128,117 | A | * | 10/2000 | Kim | 398/115 |
| 6,160,216 | A | | 12/2000 | McMahon | |
| 6,297,455 | B1 | * | 10/2001 | Wijnberg et al. | 174/113 R |
| 6,310,286 | B1 | * | 10/2001 | Troxel et al. | 174/36 |

FOREIGN PATENT DOCUMENTS

| | | |
|---|---|---|
| DE | 37 22 747 | 4/1989 |
| DE | 296 18 744 | 3/1997 |
| GB | 829189 | 3/1960 |

* cited by examiner

*Primary Examiner*—William H. Mayo, III
(74) *Attorney, Agent, or Firm*—Daly, Crowley, Mofford & Durkee, LLP

(57) ABSTRACT

An electrical cable has a central conductor structure and a plurality of spiral conductor structures spirally wrapped around the central conductor structure. Each of the spiral conductor structures includes an electrically conducting spiral conductor, and a spiral conductor insulation overlying the spiral conductor. Each spiral conductor structure has no electrically conducting shielding thereon. Each spiral conductor structure retains a same pair of circumferentially adjacent spiral conductor structures along a length of the electrical cable. Each spiral conductor structure has a designated identity, and a circumferential arrangement of each spiral conductor structure is selected responsive to its designated identity and to the designated identities of each of the pair of circumferentially adjacent spiral conductor structures. An electrically conducting outer shield overlies the plurality of spiral conductors, and an outer insulation overlies the electrically conducting outer shield. The electrical cable is substantially circular viewed in cross section perpendicular to the local longitudinal axis.

28 Claims, 2 Drawing Sheets

ELECTRICAL CABLE HAVING AN ORGANIZED SIGNAL PLACEMENT AND ITS PREPARATION

This invention relates to electrical cables and their preparation and, more particularly, to an electrical cable having a coaxial central conductor structure and spiral conductor structures that are arranged in an identity-based organization and spirally wound over the central conductor structure.

BACKGROUND OF THE INVENTION

An electrical signal carried on a wire generates electrical and magnetic fields in proximity to the wire along its entire length. These fields extend beyond the wire's copper conductor and through its insulation into the surrounding space. If other wires are near the generating wire, the fields will extend through their insulations as well, coming in contact with their conductors. Electrical and magnetic interactions will occur, generating new currents on the other wires. This phenomenon is termed "crosstalk" and is normally considered detrimental to the operation of the affected circuits. However, at low levels or specific electrical frequencies, crosstalk is often inconsequential, depending upon the nature of the "victim" signal.

Shielding for individual wires or pairs of wires is often built into cables to reduce and control crosstalk. Wires used for sensitive signals are usually shielded, and noisy circuits are unshielded as opposed to shielding both, which would unnecessarily increase weight and cost beyond the requirement for shielding the sensitive lines.

Circuits are sensitive to a threat from other circuits on a graduated basis. It is therefore possible to arrange circuits in, for example, a flat ribbonized array, and assign specific circuits to specific positions (a good method is from highest power to lowest power) to minimize the average coupling of the circuits. The number of wire positions separating circuits directly influences their crosstalk. The more distance between wires, the less the crosstalk. Under the proper circuit parameters, this organization may also provide a crosstalk situation to which all of the circuits are tolerant, allowing safe and proper operation of the electrical equipment hooked up to the wires without using shielding on any of the wires or pairs.

This organizing of circuits on flat ribbons without the utilization of shielded wires is one of the main technical practices of Ribbonized Organized Integrated (ROI) wiring, an "Organized Wiring" methodology used in many military and some commercial aircraft wiring systems. ROI ribbon harnesses use as many as six or even more woven wire ribbons stacked in a pack, separated by electrically grounded copper foils and normally covered by a braided shield. The foils between ribbons reduce coupling from ribbon to ribbon, and the braided shield prevents sources of interference outside of the harness from causing crosstalk effects.

Some types of electrical cables include a number of separate conductors that carry a number of different types of electrical signals. (As used herein, a "cable" has a generally round cross section, as distinct from the flat cross section of the ribbon.) In an example of interest, an in-flight entertainment (IFE) system in an airliner may include, at each seat, a television with headphone connections, an electrical connection, a telephone connection, and a data port. Such an in-flight entertainment system requires a video signal, an audio signal, a power signal, a telephone signal, data signals, and control signals at each seatback. Some of these signals may be multiplexed and share the same transmission wires.

All of these electrical signals are carried on wires that are bundled into an IFE electrical cable for compactness, neatness, and convenience in installation and maintenance.

Some of the bundled wires in the electrical cable carry electrical signals that may interfere with each other or with the other electrical functionality of the aircraft, or which may be interfered with by other electrical signals in the aircraft. To prevent such interference, some of the wires are shielded with a grounded metallic shield, and the exterior of the entire cable may be shielded with another grounded metallic shield. Such shielding adds weight, bulk, and cost to the electrical cable. The physical spaces allocated to the electrical cables are tightly constrained. In some cases the sizes of the electrical conductors within the electrical cable must be made smaller than desired in order to fit within the allocated spaces, taking into account the presence of the shielding and the insulation, or shielding is limited or removed. The result is that the performance of the IFE system is compromised. This background discussion has focused on IFE systems, but the same problems arise in other types of aircraft and other electrical cable systems.

There is a need for an improved approach to electrical cables that must carry different types of electrical signals and are constrained in weight and/or size. The present invention fulfills this need, and further provides related advantages.

SUMMARY OF THE INVENTION

The present invention provides an electrical cable and a method for its preparation. The electrical cable carries electrical signals of several different kinds but does not require as much shielding as used in conventional electrical cables that carry the same kinds of electrical signals. Interference between the various electrical signals carried on the electrical cable is minimized, and interference with or by external electrical signals is avoided. The electrical cable is round and flexible, important attributes for aircraft applications where the cable must be bendable in two orthogonal planes to fit into tight spaces, as distinct from flat ribbons that are bendable only in one plane. The round cable places low stresses on the connectors, as distinct from flat ribbonized structures which may place higher stresses on the connectors. The electrical cable may be reduced in size as compared with conventional electrical cables that have more shielding or, alternatively, the same size of electrical cable may have larger electrical conductors. The electrical cable may also use individual carriers of different sizes but still be round and flexible. The electrical cable of the present approach may be readily manufactured by automated techniques, unlike flat ribbonized structures.

In accordance with the invention, an electrical cable has a local longitudinal axis and comprises a central conductor structure comprising an electrically conducting central conductor, a layer of a central conductor insulation overlying the central conductor, and an electrically conducting central conductor shield overlying the layer of central conductor insulation. A plurality of spiral conductor structures overlie and spirally wrap around the central conductor structure. Each of the spiral conductor structures comprises an electrically conducting spiral conductor, and a spiral conductor insulation overlying the spiral conductor. Each spiral conductor structure preferably has no electrically conducting shielding thereon. There may be a spiral spacer structure spirally wrapped around the central conductor structure and lying between two spiral conductor structures in a side-by-side relationship. An electrically conducting outer shield overlies the plurality of spiral conductors, and an outer insulation overlies the electrically conducting outer shield. Desirably, the electrical cable is substantially circular viewed in cross section perpendicular to the local longitudinal axis, although it may be somewhat out of round and still be functional.

The central conductor may comprise a plurality of electrically conducting central conductor wires. The central conductor may be a coaxial wire structure. Each of the spiral conductors may comprise a plurality of electrically conducting spiral conductor wires. In one embodiment, the plurality of spiral conductor structures are each of substantially the same diametral size, and in another embodiment at least some of the plurality of spiral conductor structures are of different diameters. Even though the plurality of spiral conductor structures are of different diameters, the cable may still be substantially circular/round in cross section.

The reduction in shielding of the electrical cable is achieved by not shielding the spiral conductor structures. To eliminate this shielding yet avoid interference and crosstalk between the spiral conductor structures, each spiral conductor structure retains a same pair of circumferentially adjacent spiral conductor structures along a length of the electrical cable. Each spiral conductor structure has a designated identity, and a circumferential arrangement of each spiral conductor structure is selected responsive to its designated identity and to the designated identities of each of a pair of circumferentially adjacent spiral conductor structures.

An electrical cable is prepared by providing the central conductor structure and the plurality of spiral conductors as previously described. A circumferential arrangement of each spiral conductor structure is selected responsive to its designated identity and to the designated identities of each of a pair of circumferentially adjacent spiral conductor structures. The spiral conductor structures are wrapped around the central conductor structure in a spiral pattern, each spiral conductor structure retaining the same pair of circumferentially adjacent spiral conductor structures along a length of the electrical cable. The electrically conducting outer shield is placed overlying the spiral conductor structures that are wrapped onto the central conductor structure, and an outer insulation is placed overlying the outer shield to form the electrical cable having a local longitudinal axis. Other features of the electrical cable described elsewhere herein may be used in conjunction with this method.

The present approach provides an electrical cable that is round and flexible, and has reduced shielding requirements as compared with conventional electrical cables that carry mixed signals. It has features that are more favorable than those of flat, ribbonized conductor structures for many applications. In addition to those discussed earlier such as improved flexibility due to its round cross section, it has reduced weight and volume. The central conductor structure is shielded by its own shielding, by the spiral conductor structures, and by the outer shielding. There are no "end effects" in the round cable comparable with those of the flat, ribbonized structure, where the conductors at the lateral edges of the structure can radiate crosstalk signals or be adversely affected by external signals. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
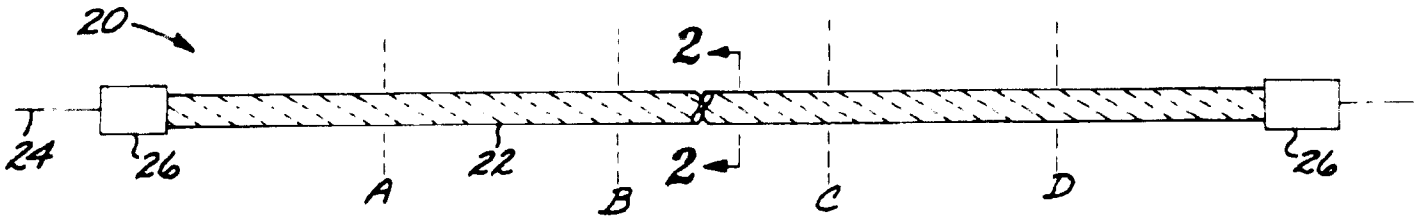
FIG. 1 is a schematic elevational view of an electrical cable according to the invention.

FIG. 1 depicts an electrical cable structure 20 including an electrical cable 22 having a local longitudinal axis 24. The "longitudinal axis" is the axis through the center of the electrical cable 22 extending parallel to its direction of elongation. It is termed a "local" longitudinal axis because it the electrical cable 22 may be bent or otherwise nonlinear, and the local longitudinal axis 24 is determined at each local position along a length of the electrical cable 22. Electrical connectors 26 are attached to each end of the electrical cable 22 for some applications. For other applications there may be no electrical connectors, and the electrical cable 22 is hard wired at its ends, or there may be one hard-wired end and one end with the connector 26.

Figure 2:
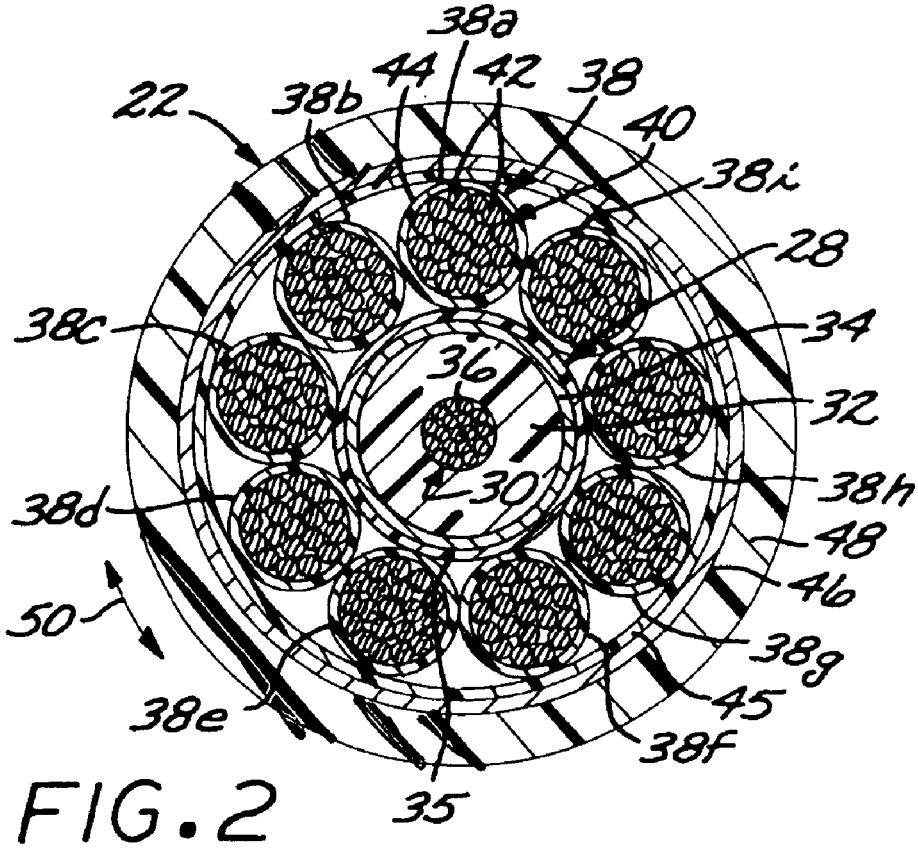
FIG. 2 is an enlarged schematic sectional view of the electrical cable of FIG. 1, taken on line 2—2.

Referring to the sectional view of FIG. 2 taken perpendicular to the local longitudinal axis 24, the electrical cable structure 20 is generally round in cross section. By comparison, a ribbon electrical conductor is flat in cross section, with a width dimension much larger than a thickness dimension. This round cable may be bent in two orthogonal planes that include the longitudinal axis 24, while the ribbon may be bent only in one plane. This round geometry of the cable has important advantages in regard to the positioning of electrical conductors, as will be discussed subsequently.

The electrical cable 22 has a central conductor structure 28 with an electrically conducting central conductor 30, a layer of a central conductor insulation 32 overlying the central conductor 30, an electrically conducting central conductor shield 34 overlying the layer of central conductor dielectric insulation 32, and an optional layer of central conductor outer insulation 35 overlying the central conductor shield 34. The central conductor 30 is preferably made of a plurality of individual central conductor wires 36 arranged as a coaxial conductor extending parallel to the local longitudinal axis 24. The central conductor wires 36 are typically not individually insulated. In an in-flight-entertainment system, the central conductor 30 typically carries an analog video signal, a digital video signal, or a multiplexed radio-frequency signal.

A plurality of spiral conductor structures 38 overlie and are spirally wrapped around the central conductor structure 28, The spiral wrapping by the spiral conductor structures 38 of the central conductor structure 28 is depicted in FIG. 1 by the dashed lines. In the illustration of FIG. 2, there are nine such spiral conductor structures, 38*a*, 38*b*, 38*c*, 38*d*, 38*e*, 38*f*, 38*g*, 38*h*, and 38*i*, although there may be fewer or more spiral conductor structures in the electrical cable 22. Each of the spiral conductor structures 38 comprises an electrically conducting conductor 40. Each of the spiral conductors 40 is illustrated as a plurality of electrically conducting spiral conductor wires 42. The spiral conductor wires 42 are typically not individually insulated. A spiral conductor insulation 44 overlies the spiral conductor 38. Each spiral conductor structure 36 has no electrically conducting shielding thereon. In this embodiment, the plurality of spiral conductor structures 28 are each round when viewed in the cross sectional of FIG. 2 perpendicular to the local longitudinal axis 24 and of substantially the same diameter.

A layer of an external insulation 45 overlies the plurality of spiral conductors 38. The layer of external insulation 45 may be a tape wrap of an insulating tape, if desired. An electrically conducting outer shield 46 overlies the layer of the external insulation 45. An outer insulation 48 overlies the electrically conducting outer shield 46.

A desirable feature of the electrical cable 22 is that it is substantially circular when viewed in the cross section of FIG. 2 perpendicular to the local longitudinal axis 24. By having a circular electrical cable 22, the plurality of central conductor wires 36, and the plurality of spiral conductor wires 42, the electrical cable 22 is made highly flexible. The flexibility aids in installation of the electrical cable 22 in confined spaces.

In the preferred embodiment, each spiral conductor structure 38 retains a same pair of circumferentially adjacent spiral conductor structures along a length of the electrical cable 22. Any one of the spiral conductor structures has, on either side of it around the circumference of the electrical cable 22, the same neighboring spiral conductor structures at all locations along the length of the electrical cable 22. As an illustrative example, in the sectional view of FIG. 2 spiral conductor structure 38*d* has two circumferentially adjacent spiral conductor structures 38*c* and 38*e*, one on either circumferential side of the spiral conductor structure 38*d*. (A circumferential direction 50 is illustrated in FIG. 2.) If sectional views like FIG. 2 were taken at any other locations such as locations A, B, C, or D of FIG. 1, the spiral conductor structure 38*d* would lie circumferentially between the spiral conductor structures 38*c* and 38*e* (although the entire arrangement might be rotated about the local longitudinal axis 24). The same relative circumferentially adjacent relationships are maintained for each of the spiral conductor structures 38*a*, 38*b*, 38*c*, 38*d*, 38*e*, 38*f*, 38*g*, 38*h*, and 38*i*, and its respective circumferentially adjacent spiral conductor structures, along the length of the electrical cable 22. Each of the spiral conductor structures 38*a*, 38*b*, 38*c*, 38*d*, 38*e*, 38*f*, 38*g*, 38*h*, and 38*i* has a designated identity as to the type of electrical signals that it carries, and a specific example will be discussed subsequently. The spiral conductor insulation 44 of each spiral conductor structure 38 may be color coded to facilitate the maintenance of the same relationships between adjacent spiral conductor structures along the length of the electrical cable 22.

A circumferential arrangement of each spiral conductor structure is selected responsive to its designated identity and to the designated identities of each of a pair of circumferentially adjacent spiral conductor structures. Because each of the spiral conductor structures 38 is radially sandwiched between the electrically grounded shields 34 and 46, crosstalk and other electrical interferences are determined primarily by the circumferentially adjacent spiral conductor structures. Continuing the example from above, the circumferential arrangement of each spiral conductor structure 38*d* is selected with consideration for its designated identity and those of the circumferentially adjacent spiral conductor structures 38*c* and 38*e*.

Organizing circuits into a round cable follows a systematic process of rules and relationships to minimize electrical interactions between the various spiral conductor structures 38. Electrical crosstalk between wires is predictable to the point that if the geometry of the wire positioning is known and controlled, and the electrical parameters of the signals on the wires are known, then rules may be formulated to assign circuits to specific positions where detrimental coupling between specific circuits will not occur or at least will be minimal and acceptably small. These rules are based on empirical test data, where generic circuit arrangements of flat ribbon geometries were used under test conditions to measure electrical coupling between two circuits running on wires placed in various locations in the harness. Measurements were taken with circuits on conductors next to each other, one conductor apart, two conductors apart, and so forth. These tests were conducted across the useful frequency ranges and at various circuit impedance levels. The testing yields design relations of the amount of power coupled from one conductor to the other at the various frequencies and for conductors positioned next to each other, one conductor apart, two conductors apart, and so forth.

Round cables using this approach preserve the relationship between conductors along the entire length of the electrical cable 22. The various individual conductors never change positions relative to each other. As a result, once the successful organization is identified, it is consistent and does not change. The design process for round cables differs significantly from that for flat ribbons in that there are not two lateral sides of the structure wherein the signals of most potential interference may be spaced apart by all of the other conductors. In a round cable, the conductors must be arranged in an annular arrangement for minimal interference.

The following are the primary design parameters resulting from the testing. First, a conductor's sensitivity to cross talk is based primarily on the electrical power carried by the conductor relative to the electrical power of adjacent conductors. Second, the coupling of conductors rises as the frequency of the signal rises. Third, circuits couple less as they are positioned further apart around the circumference of the cable.

Based on these design parameters, the following basic rules of organization were developed. First, conductors operating at low frequencies do not crosstalk to other conductors. Most circuits fall into this category. However, they may be victims of crosstalk from other circuits, and therefore the other organizational rules are necessary.

Second, circuits of similar power levels are best grouped together in adjacent locations. A practical power-level grouping for circuits is based upon decades of power in watts, such as 0.1–1 watt, 1–10 watts, 10–100 watts, and so on. Circuits of similar power, lying in the same power decade, are segregated together away from circuits that are of much higher power and therefore are potentially dangerous in terms of originating crosstalk. Conductors classified as part of the "next highest" or "next lowest" decade of power may be placed adjacent to a first conductor, but conductors of the groups two decades higher or two decades lower must be separated from the first conductor by a "guardwire". Guardwires are conductors that are electrically grounded to form a coupling barrier between the conductors.

Third, circuits operating above a design frequency are isolated with guardwires on both sides of the high-frequency conductor. The guardwires form a barrier to the high frequency fields generated.

Fourth, as circuits are placed further apart in position, they quickly lose their ability to couple due to two factors. The first is increased separation distance, because field strength is inversely proportional to the square of the distance from the conductor. The second is the amount of conductive material between non-adjacent wires which grounds the field. For all practical purposes, conductors that are separated by 3–4 other conductors from a potential source of crosstalk are completely isolated from that crosstalk at useful frequencies. Further, the central conductor shield 34 and the outer shield 46 serve as part of the isolating structure.

As an example, these principles were used to design the electrical cable structure 20 used in an in-flight entertainment (IFE) system based on the electrical cable 22 of FIG. 2. In this design, spiral conductor structure 38*a* is 115 volts AC; spiral conductor structure 38*b* is 115 volts AC return (neutral); spiral conductor structure 38*c* is data select, which is insensitive to the AC return in spiral conductor structure 38*b*, is insensitive to the signal (discussed next) in spiral conductor structure 38*d*, and does not adversely affect the signals in spiral conductor structures 38*b* and 38*d*; spiral conductor structure 38*d* is Databus 1 LO; spiral conductor structure 38*e* is Databus 1 HI; spiral conductor structure 38*f* is a grounded guardwire to separate the signals in spiral conductor structures 38*e* and 38*g*; spiral conductor structure 38*g* is Databus 2 HI; spiral conductor structure 38*h* is Databus 2 LO, and spiral conductor structure 38*i* is signal ground, which is immune to the signals carried in the databus conductors and also to the 115 volt power in adjacent spiral conductor structure 38*a*, and will not harm their operations. That is, spiral conductor structure 38*i* resides next to and is compatible with spiral conductor structure 38*a*, completing the annular arrangement of the spiral conductors 38. The central conductor 30 carries the video signal in analog or digital form.

This organized configuration of the IFE cable is presented as an example, and is not limiting of the invention. Other multi-conductor applications carrying other power levels and frequencies of signals will have other configurations according to the organizational rules discussed earlier or other organizational rules that may be developed and/or applied specific to the applications. For example, very high frequencies and fast rise times in the signals carried by a conductor increase the potential adverse effects on neighboring conductors. Additionally, other configurations may have two or more overlying layers of spiral conductor structures. These layers would be alternatively spiraled left then right to obtain both high concentricity and flexibility.

Figure 3:
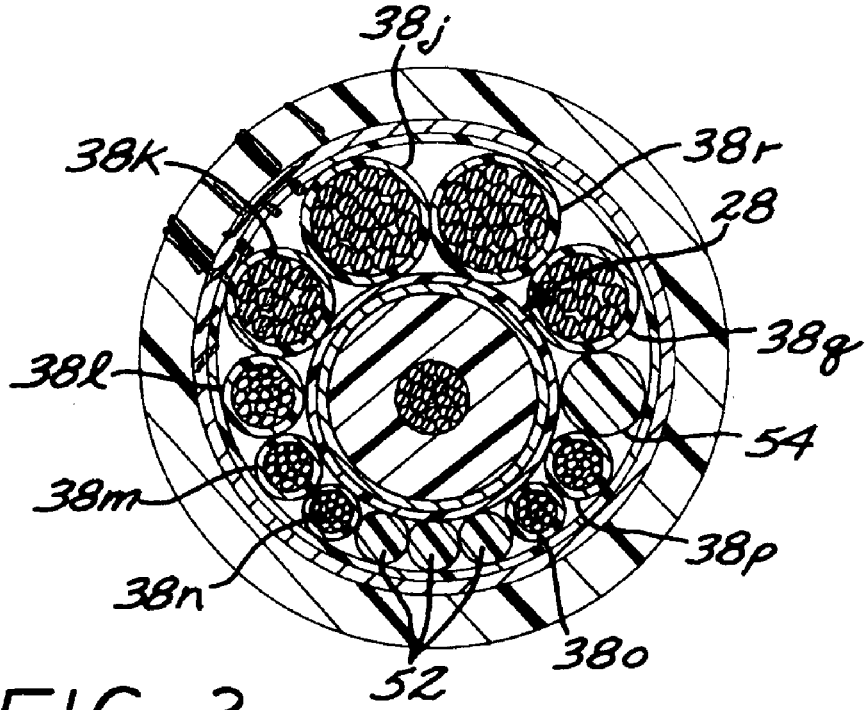
FIG. 3 is a schematic sectional view like that of FIG. 2, of a second embodiment of the electrical cable.

Another embodiment of the electrical cable 22 is illustrated in FIG. 3. This embodiment utilizes many of the same elements and features as discussed previously, and that discussion is incorporated here to the extent applicable. The discussion of FIG. 3 will emphasize differences between the embodiments of FIGS. 2 and 3. In FIG. 3, some of the applicable reference numerals are omitted to avoid clutter.

The embodiment of FIG. 3 includes spiral conductor structures 38*j*, 38*k*, 38*l*, 38*m*, 38*n*, 38*o*, 38*p*, 38*q*, and 38*r*. Unlike the embodiment of FIG. 2 wherein all of the spiral conductor structures 38 are of the same diameter, in the embodiment of FIG. 3 some of the spiral conductor structures 38 are of different diameters. The different diameters are expected in some applications, for example where a spiral conductor structure carrying a power signal would typically require a larger size of spiral conductor than would a spiral conductor structure carrying a low-current control signal. However, by judicious arrangement of the spiral conductor structures 38 so that the larger sizes are grouped together on one side of the electrical cable 22 and smaller spiral conductor structures 38 are grouped together on the other side of the electrical cable, the electrical cable 22 remains substantially circular when viewed in cross section and has a smaller diameter than a cable with all of the same gauge spiral conductor structures. Retaining the generally circular cross section is highly desirable to impart flexibility in orthogonal directions to the electrical cable. This type of arrangement of conductor structures of very different sizes (i.e., wire gauges) cannot be practically made using a flat ribbonized structure.

If the cable application dictates that there are insufficient numbers of spiral conductor structures 38 to fill all of the spaces required in this arrangement, spiral spacer structures 52 of the required diameter may be positioned adjacent to the spiral conductor structures 38 at the appropriate locations. The spiral spacer structure 52 is a length of electrically nonconducting material. The spiral spacer structure 52 may be of any nonconducting material that may be spirally wrapped in a manner comparable with that of the spiral conductor structures 38. In mixed-mode cable systems wherein at least some of the elements of the cable are optical conductors such as optical fibers, the optical conductors, which are not susceptible to electrical crosstalk interference and do not generate electrical crosstalk interference, may be used as the spiral spacer structure 52. A spiral spacer structure 54 may also lie between two spiral conductor structures 38 (illustrated as the spiral conductor structures 38*p* and 38*q*) in a side-by-side relationship for electrical isolation purposes. In each case, the spiral spacer structure 52 or 54 is wrapped spirally around the central core structure 28 in the same manner described previously for the spiral conductor structures 38, except that the spiral spacer structure effectively replaces one of the spiral conductor structures with an electrical nonconductor. Spiral spacer structures may also be used in relation to the embodiment of FIG. 2.

Figure 4:
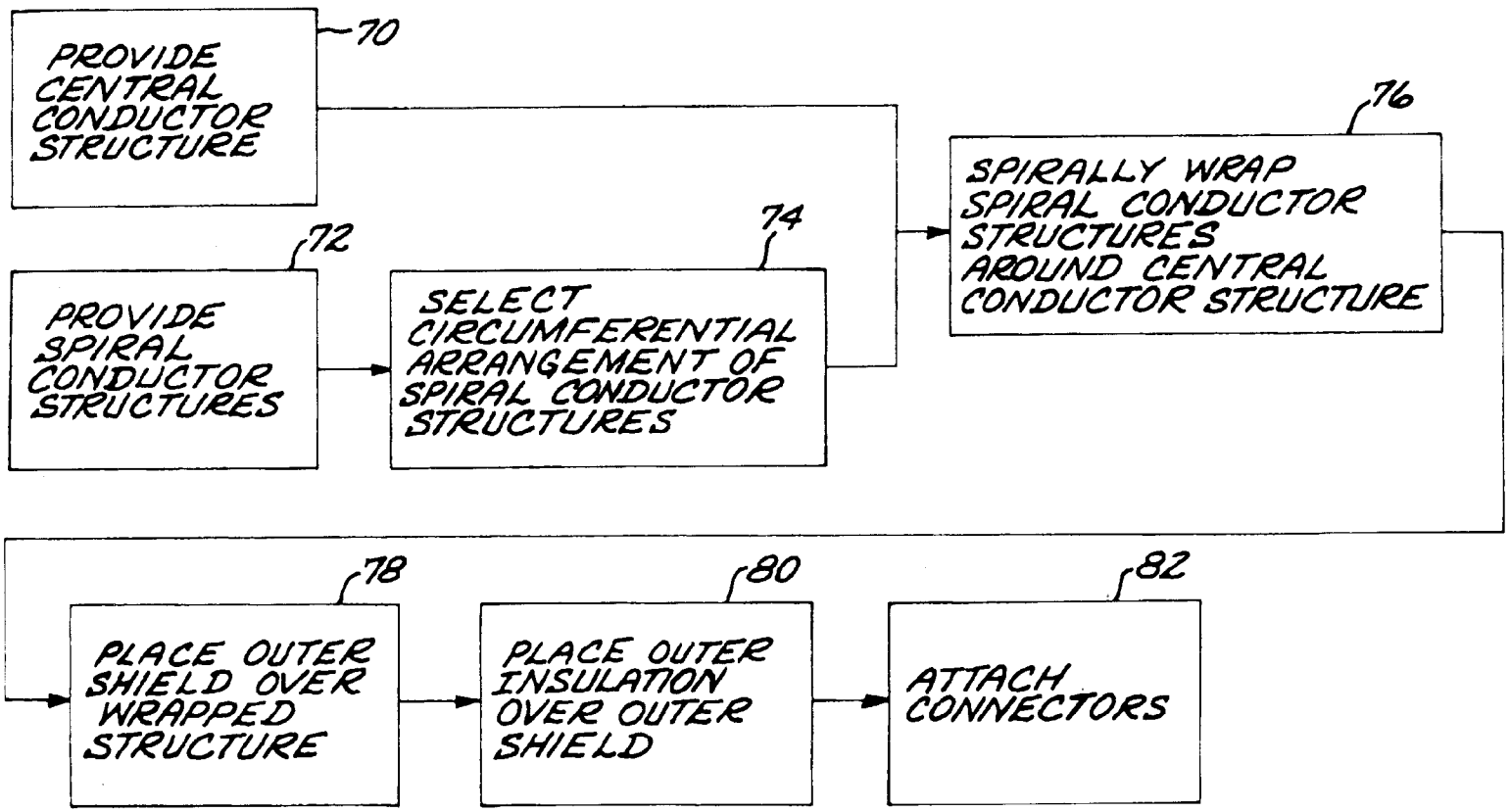
FIG. 4 is a block flow diagram of a method for preparing the electrical cable.

In a typical case of an electrical cable 22 of diameter about 0.350 inch, the central conductor 30 includes central conductor wires 36 made of silver-plated copper and each of diameter about 0.0080 inch, with the total diameter of the central conductor 30 about 0.040 inch (20 AWG). The central conductor insulation 32 is a fluoropolymer of outside diameter about 0.100 inch. The central conductor shield 34 is silver-plated copper having an outside diameter of about 0.120 inch. The central conductor structure 28 has an outside diameter of about 0.132 inch. For the FIG. 2 embodiment, there are nine spiral conductor structures 38 of the same diameter. The spiral conductor 40 is spiral conductor wires 42 made of tin-plated copper and each of diameter about 0.010 inch (30 AWG), with the total diameter of the spiral conductor 40 about 0.050 inch (18 AWG). The spiral conductor insulation 44 is a fluoropolymer about 0.008 inch thick. The outer shield 46 is tin-plated copper about 0.290 inch outside diameter. The outer insulation 48 is a fluoropolymer of about 0.350 inch outside diameter. The other insulation layers are also preferably a fluoropolymer such as polytetrafluoroethylene. The spiral spacer structures 52 and 54 are a fluoropolymer of the required diameter FIG. 4 illustrates an approach for making an electrical cable 22 and an electrical cable structure 20. The central conductor structure 28 is prepared and provided, numeral 70. The spiral conductor structures 38 are prepared and provided, numeral 72. Spiral spacer structures 52, 54 may also be provided. Each of the spiral conductor structures 38 has its designated identity. The circumferential arrangement of the spiral conductor structures 38 (or spiral spacer structure 52, 54) is selected responsive to their designated identities and to the designated identities of each of a pair of circumferentially adjacent spiral conductor structures, numeral 74, using the techniques discussed earlier. The spiral conductor structures 38 (and spiral spacer structures 52, 54, where used) are spirally wrapped around the central conductor structure 28, numeral 76. The external insulation 45 is applied. The outer shield 46 is placed over the wrapped structure, numeral 78, and the outer insulation 48 is placed over the outer shield 46. The electrical cable 22 is complete. Where electrical connectors 26 are used, all connectors are attached, numeral 82, typically by attaching the wires of the electrical cable to connector elements (such as pins) of the connector(s) 26.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An electrical cable having a local longitudinal axis and comprising:

a central conductor structure comprising an electrically conducting central conductor, a layer of a central conductor insulation overlying the central conductor, and an electrically conducting central conductor shield overlying the layer of central conductor insulation;

a plurality of spiral conductor structures overlying and spirally wrapped around the central conductor structure, wherein each spiral conductor structure retains a same pair of circumferentially adjacent spiral conductor structures along a length of the electrical cable, wherein each of the spiral conductor structures comprises an electrically conducting spiral conductor, and a spiral conductor insulation overlying the spiral conductor, wherein the spiral conductor structures have no electrically conducting shielding, wherein at least some of the spiral conductor structures have different signal-carrying identities, and wherein at least some of the spiral conductor structures having different signal-carrying identities are arranged responsive to a crosstalk threat between the various spiral conductor structures;

an electrically conducting outer shield overlying the plurality of spiral conductors; and an outer insulation overlying the electrically conducting outer shield.

2. The electrical cable of claim 1, wherein the electrical cable is substantially circular viewed in cross section perpendicular to the local longitudinal axis.

3. The electrical cable of claim 1, wherein the central conductor comprises a plurality of electrically conducting central conductor wires.

4. The electrical cable of claim 1, wherein the central conductor is a coaxial wire structure.

5. The electrical cable of claim 1, wherein each spiral conductor comprises a plurality of electrically conducting spiral conductor wires.

6. The electrical cable of claim 1, wherein the plurality of spiral conductor structures are each of substantially the same diameter.

7. The electrical cable of claim 1, wherein at least some of the plurality of spiral conductor structures are of different diameters.

8. The electrical cable of claim 1, wherein each spiral conductor structure has a designated identity, and wherein a circumferential arrangement of each spiral conductor structure is selected responsive to its designated identity and to the designated identities of each of a pair of circumferentially adjacent spiral conductor structures.

9. The electrical cable of claim 1, further including a spiral spacer structure spirally wrapped around the central conductor structure, the spiral spacer structure lying between two spiral conductor structures in a side-by-side relationship.

10. The electrical cable of claim 1, wherein at least some of the spiral conductor structures have an identity selected responsive to a designed carried signal selected from the group consisting of a video signal, an audio signal, a telephone signal, a data signal, and a control signal.

11. The electrical cable of claim 1, wherein the electrical cable is a signal-carrying component of an in-flight entertainment system.

12. An electrical cable having a local longitudinal axis and comprising:

a central conductor structure comprising an electrically conducting central conductor, a layer of central conductor insulation overlying the central conductor, and an electrically conducting central conductor shield overlying the layer of central conductor insulation;

a plurality of spiral conductor structures overlying and spirally wrapped around the central conductor structure, wherein at least one of the spiral conductor structures has a signal-carrying identity and wherein each of the spiral conductor structures comprises an electrically conducting spiral conductor, and a spiral conductor insulation overlying the spiral conductor, wherein each spiral conductor structure has no electrically conducting shielding thereon, and wherein each spiral conductor structure retains a same pair of circumferentially adjacent spiral conductor structures along a length of the electrical cable, wherein each spiral conductor structure has a designated identity, and wherein a circumferential arrangement of each spiral conductor structure is selected responsive to its designated identity and to the designated identities of each of the pair of circumferentially adjacent spiral conductor structures;

an electrically conducting outer shield overlying the plurality of spiral conductors; and an outer insulation overlying the electrically conducting outer shield, wherein the electrical cable is substantially circular viewed in cross section perpendicular to the local longitudinal axis.

13. The electrical cable of claim 12, wherein the central conductor comprises a plurality of electrically conducting central conductor wires.

14. The electrical cable of claim 12, wherein each spiral conductor comprises a plurality of electrically conducting spiral conductor wires.

15. The electrical cable of claim 12, wherein the plurality of spiral conductor structures are each of substantially the same diameter.

16. The electrical cable of claim 12, wherein at least some of the plurality of spiral conductor structures are of different diameters.

17. The electrical cable of claim 12, further including a spiral spacer structure spirally wrapped around the central conductor structure, the spiral spacer structure lying between two spiral conductor structures in a side-by-side relationship.

18. A method of preparing an electrical cable, comprising the steps of providing a central conductor structure comprising an electrically conducting central conductor, a layer of central conductor insulation overlying the central conductor, and an electrically conducting central conductor shield overlying the layer of central conductor insulation;

providing a plurality of spiral conductor structures each having a designated signal-carrying identity and comprising an electrically conducting spiral conductor, and a spiral conductor insulation overlying the spiral conductor, each spiral conductor structure having no electrically conducting shielding thereon;

selecting a circumferential arrangement of each spiral conductor structure responsive to its designated identity and to the designated identities of each of a pair of circumferentially adjacent spiral conductor structures, wherein the step of selecting includes the step of arranging the spiral conductor structures responsive to a power carried by each spiral conductor structure and responsive to the power carried by the circumferentially adjacent pair of spiral conductor structures;

wrapping the spiral conductor structures around the central conductor structure in a spiral pattern, each spiral conductor structure retaining the same pair of circumferentially adjacent spiral conductor structures along a length of the electrical cable;

placing an electrically conducting outer shield overlying the spiral conductor structures that are wrapped onto the central conductor structure; and placing an outer insulation overlying the outer shield to form the electrical cable having a local longitudinal axis.

19. The method of claim 18, wherein the plurality of spiral conductor structures are each of substantially the same diameter.

20. The method of claim 18, wherein at least some of the plurality of spiral conductor structures are of different diameters.

21. The method of claim 18, wherein the electrical cable is substantially circular viewed in cross section perpendicular to the local longitudinal axis.

22. The method of claim 18, wherein at least some of the spiral conductor structures have an identity selected responsive to a designed carried signal selected from the group consisting of a video signal, an audio signal, a power signal, a telephone signal, a data signal, and a control signal.

23. A method of preparing an electrical cable, comprising the steps of providing a central conductor structure comprising an electrically conducting central conductor, a layer of central conductor insulation overlying the central conductor, and an electrically conducting central conductor shield overlying the layer of central conductor insulation;

providing a plurality of spiral conductor structures each having a designated signal-carrying identity and comprising an electrically conducting spiral conductor, and a spiral conductor insulation overlying the spiral conductor, each spiral conductor structure having no electrically conducting shielding thereon;

selecting a circumferential arrangement of each spiral conductor structure responsive to its designated identity and to the designated identities of each of a pair of circumferentially adjacent spiral conductor structures, wherein the step of selecting includes the step of arranging the spiral conductor structures responsive to a crosstalk characteristic thereof;

wrapping the spiral conductor structures around the central conductor structure in a spiral pattern, each spiral conductor structure retaining the same pair of circumferentially adjacent spiral conductor structures along a length of the electrical cable;

placing an electrically conducting outer shield overlying the spiral conductor structures that are wrapped onto the central conductor structure; and placing an outer insulation overlying the outer shield to form the electrical cable having a local longitudinal axis.

24. An electrical cable having a local longitudinal axis and comprising:

a central conductor structure comprising an electrically conducting central conductor, a layer of a central conductor insulation overlying the central conductor, and an electrically conducting central conductor shield overlying the layer of central conductor insulation;

a plurality of spiral conductor structures overlying and spirally wrapped around the central conductor structure, each of the spiral conductor structures comprising an electrically conducting spiral conductor, and a spiral conductor insulation overlying the spiral conductor, wherein each spiral conductor structure is unshielded, wherein each of the spiral conductor structures has a designated identity, and wherein at least a first one of the spiral conductor structures has two circumferentially adjacent spiral conductor structures each having a different identity than the first one of the spiral conductor structures;

an electrically conducting outer shield overlying the plurality of spiral conductors; and an outer insulation overlying the electrically conducting outer shield.

25. An electrical cable having a local longitudinal axis and comprising:

a central conductor structure comprising an electrically conducting central conductor, a layer of a central conductor insulation overlying the central conductor, and an electrically conducting central conductor shield overlying the layer of central conductor insulation;

a plurality of spiral conductor structures overlying and spirally wrapped around the central conductor structure, wherein a circumferential positioning of the spiral conductor structures relative to each other is responsive to a signal carried by each spiral conductor structure, and wherein each of the spiral conductor structures comprises an electrically conducting spiral conductor, and a spiral conductor insulation overlying the spiral conductor, wherein each spiral conductor structure is unshielded;

an electrically conducting outer shield overlying the plurality of spiral conductors; and an outer insulation overlying the electrically conducting outer shield.

26. The electrical cable of claim 25, wherein each spiral conductor structure retains a same pair of circumferentially adjacent spiral conductor structures along a length of the electrical cable.

27. The electrical cable of claim 25, wherein each spiral conductor structure retains a same pair of circumferentially adjacent spiral conductor structures along a length of the electrical cable, and wherein the same pair of circumferentially adjacent spiral conductor structures is selected according to the signal carried by each of the three spiral conductor structures.

28. The electrical cable of claim 25, wherein at least some of the spiral conductor structures have an identity selected responsive to a designed carried signal selected from the group consisting of a video signal, an audio signal, a power signal, a telephone signal, a data signal, and a control signal.

* * * * *

UNITED STATES PATENT AND TRADEMARK OFFICE

CERTIFICATE OF CORRECTION

PATENT NO. : 7,060,905 B1
APPLICATION NO. : 09/990723
DATED : June 13, 2006
INVENTOR(S) : Roy P. McMahon It is certified that error appears in the above-identified patent and that said Letters Patent is hereby corrected as shown below:

Column 4, lines 15-16 delete “because it the electrical” and replace with --because the electrical--.

Column 8, line 58-59, delete “structure 52,54)” and replace with --structures 52,54)--.

Signed and Sealed this

Nineteenth Day of December, 2006

JON W. DUDAS
*Director of the United States Patent and Trademark Office*